US006175993B1

(12) United States Patent
Gilman et al.

(10) Patent No.: US 6,175,993 B1
(45) Date of Patent: Jan. 23, 2001

(54) SHIRT-LOCKING DEVICE

(76) Inventors: Arthur S. Gilman, 2100 S. Ocean Blvd., Palm Beach, FL (US) 33480; Jeffrey S. Gilman, 241 White Pond Rd., Hudson, MA (US) 01749

( * ) Notice: Under 35 U.S.C. 154(b), the term of this patent shall be extended for 0 days.

(21) Appl. No.: 09/200,357

(22) Filed: Nov. 25, 1998

(51) Int. Cl.[7] ..... A44B 21/00
(52) U.S. Cl. ..... 24/13; 24/710.2
(58) Field of Search ..... 24/710.2, 709.6, 24/709.7, 709.8, 709.9, 710, 710.1, 13; 40/664

(56) References Cited

U.S. PATENT DOCUMENTS

| | | | |
|---|---|---|---|
| 361,886 | * | 4/1887 | Nichols . |
| 691,361 | * | 1/1902 | Davis . |
| 817,417 | | 4/1906 | Clarke . |
| 878,069 | * | 2/1908 | Josephs . |
| 897,146 | * | 8/1908 | Pullins . |
| 1,588,709 | | 6/1926 | Dinkelbihler . |
| 2,086,767 | | 7/1937 | Haas . |
| 2,418,774 | | 4/1947 | Katz . |
| 3,461,597 | * | 8/1969 | Hobson . |
| 3,699,617 | | 10/1972 | Hofmeister . |
| 4,301,610 | * | 11/1981 | Brown . |
| 5,027,545 | * | 7/1991 | Lowrie et al. . |
| 5,177,814 | | 1/1993 | Courtney . |
| 5,224,286 | * | 7/1993 | Wadiak . |
| 5,457,852 | * | 10/1995 | Liu . |
| 5,680,726 | * | 10/1997 | Sassone . |

* cited by examiner

*Primary Examiner*—James R. Brittain
(74) *Attorney, Agent, or Firm*—Kriegsman & Kriegsman

(57) ABSTRACT

In one embodiment of the present invention, a shirt-locking device comprises a fastening device and a weight slidably mounted on the fastening device. The fastening device includes a central portion having a first end and a second end, the first end of the central portion being in the shape of a pin and the second end of the central portion being in the shape of a cooperating hook for holding the first end in a closed position. The weight is approximately 1 ounce and includes a bore into which the central portion of the fastening device is disposed. In another embodiment of the present invention, a shirt-locking device comprises a fastening device, a generally U-shaped bracket mounted on the fastening device and a weight slidably mounted on the bracket. In use, the fastening device of both shirt-locking device embodiments can be used to affix the bottom portion of a shirt, or other similar material, in a tucked position down and against an undergarment, or other similar garment.

1 Claim, 1 Drawing Sheet

SHIRT-LOCKING DEVICE

BACKGROUND OF THE INVENTION

The present invention relates generally to fastening devices and, more particularly, to fastening devices for detachably securing two articles of clothing together.

It is well known for a person to wear a shirt, or other similar garment, with a pair of pants, or other similar garment. In order to create a neat and tidy appearance, a person typically disposes the shirt in a tucked position within the pair of pants.

However, it has been found that frequently the lower portion of the shirt tends ride upwardly above the waistline of the wearer, thereby creating a partially tucked or untucked appearance, which is undesirable. In particular, it has been found that the participation of demanding physical activity, such as the participation of athletics, often causes the lower portion of the shirt of a wearer to bulge outward or to become untucked from the pants of the wearer.

Accordingly, clothing pins, also commonly referred to as beauty pins, have been used to fixedly connect two articles of clothing together. Using one or more clothing pins to affix the shirt of a wearer onto the pants or undergarment of the wearer assists in preventing the shirt from becoming untucked during the participation of athletic activities.

However, it has been found that, in order to work effectively, clothing pins need to be positioned at the location of the greatest untucking force. Otherwise, if the clothing pin is not centered properly at the location of the greatest untucking force, the pin will ineffectively retain the shirt within the pants of the wearer.

In U.S. Pat. No. 1,588,709 to S. Dinkelbihler, there is disclosed a fastener for securing two garments together which comprises two straight flat parts of considerable length and substantial width. Each of the two straight flat parts is provided with a pin on one side and a cooperating hook for holding the pin in a closed position on the other side. The opposite side of the two straight flat parts include snap fasteners for detachably connecting the parts together. The fastener includes at least two, spaced apart, snap fasteners so that the two straight flat parts are prevented from moving out of alinement when connected thereby.

In U.S. Pat. No. 2,086,767 to I. O. Haas, there is disclosed a lingerie strap holder comprising a beauty pin having a substantially U-shaped loop secured at one end. The U-shaped loop has at its free end a portion in-turned toward the pin and then inclined away from the pin toward the bottom of the loop, terminating in a curved loop lying in a plane at right angles to that of the pin and projecting laterally in both directions from the plane of the first loop.

In U.S. Pat. No. 3,699,617 to J. M. Hofmeister, there is disclosed a connecting device for detachably joining together two articles of clothing for laundering, such as socks. The connecting device has two similar connecting members each of which is permanently attached to one garment of a pair. The connecting members each have a single stud or a pair of studs at one end which pierces one of the garments. Flanges at the opposite end of each member lock the studs in place after the member is folded upon itself securing the garment therebetween. Attachment plugs are formed on each connecting member and are snapped together detachably retaining the two garments in their proper pair.

In U.S. Pat. No. 2,418,774 to S. Katz, there is disclosed a stay-down shirt comprising a form-fitting body portion having a rear section, front sections placed side by side and secured each along one vertical edge to the rear section and means to secure the front sections detachably together. The lower edges of the front sections are arranged to terminate adjacent the waist line of an intended wearer. The shirt is cut on the rear section to provide a substantially inverted flattened V-shaped lower rear edge beginning at a point at the middle of the rear section and extending to the sides of the rear sections and a more inclined lower edge on each front section to form a substantially V-shaped lower edge at the front and rear when the front sections are secured together. The edges on the front section extend below the natural abdominal bulge of the wearer. A belt comprising elastic material is attached to the lower edges of the front and rear sections over the whole length thereof. The belt of elastic material is stretchable in the direction of its length and serves to hold the lower edges of the body portion about the body of a wearer with the inclined front edges of the front sections disposed beneath the natural level of the stomach of the wearer's abdomen.

SUMMARY OF THE INVENTION

It is an object of the present invention to provide a new and improved shirt-locking device for retaining a shirt, or other similar garment, in a tucked position within a pair of pants, or other similar garment.

It is another object of the present invention to provide a shirt-locking device as described above which can be mass produced, has a minimal number of parts, which is limited in size and can be very easily used.

Accordingly, in one embodiment of the present invention, there is provided a shirt-locking device comprising a fastening device and a weight mounted on said fastening device.

In another embodiment of the present invention, there is provided a shirt-locking device comprising a fastening device, a bracket mounted on said fastening device and a weight mounted on said bracket.

Additional objects, as well as features and advantages, of the present invention will be set forth in part in the description which follows, and in part will be obvious from the description or may be learned by practice of the invention. In the description, reference is made to the accompanying drawings which form a part thereof and in which is shown by way of illustration various embodiments for practicing the invention. The embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate various embodiments of the present invention and, together with the description, serve to explain the principles of the invention. In the drawings wherein like reference numerals represent like parts.

DETAILED DESCRIPTION OF A PREFERRED EMBODIMENT

Figure 1:
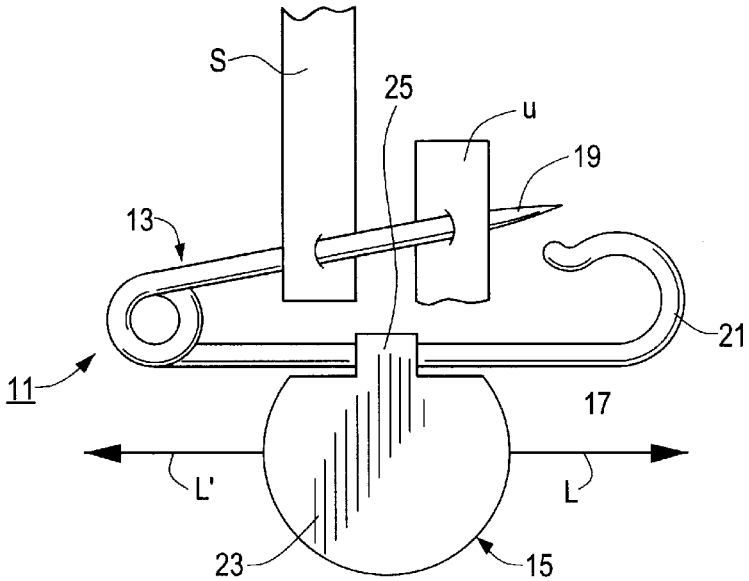
FIG. 1 is a front view of a first embodiment of a shirt-locking device constructed according to the teachings of the present invention, the shirt-locking device being shown retaining a shirt down against an undergarment.
Figure 2:
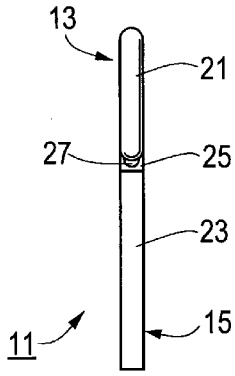
FIG. 2 is a right side view of the shirt-locking device shown in FIG. 1.
Figure 3:
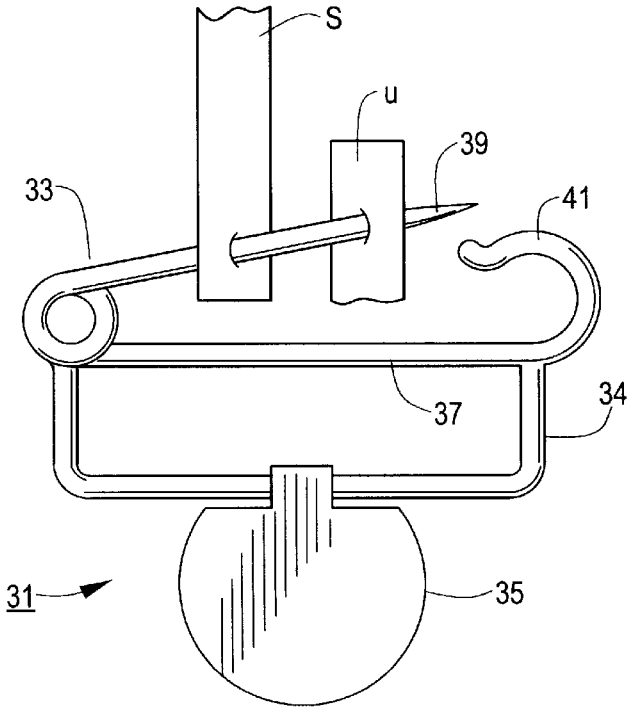
FIG. 3 is a front view of a second embodiment of a shirt-locking device constructed according to the teachings of the present invention, the shirt-locking device being shown retaining a shirt down against an undergarment.

Referring now to the drawings, there is shown a first embodiment of a shirt-locking device constructed according to the teachings of the present invention, the shirt-locking device being represented generally by reference numeral 11. As will be described further in detail below, shirt-locking device 11 can be used to retain a shirt S, or other similar garment, in a tucked position down against an undergarment U, or other similar garment.

Shirt-locking device 11 comprises a fastening device 13 and a weight 15 slidably mounted on fastening device 13.

Fastening device 13 is generally in the shape of a conventional beauty pin and comprises a central portion 17 which is generally cylindrical in shape. One end of central portion 17 is bent and sharpened to form a pin 19 capable of piercing fabrics. The other end of central portion 17 is bent to form an inwardly concave hook 21 which is adapted to hold pin 19 in a closed position therewithin.

It should be noted that although shirt-locking device 11 is shown comprising a fastening device 13 which is in the form of a conventional beauty pin, alternative types of fastening devices, such as clips, can be used in shirt-locking device 11 without departing from the spirit of the present invention.

Weight 15 is approximately 1 ounce and comprises a generally disc-shaped portion 23 and a rectangular tab 25 integrally formed on disc-shaped portion 23, rectangular tab 25 having a central, longitudinal bore 27 formed therein.

It should be noted that central portion 17 of fastening device is disposed through bore 27 formed in weight 15. As such, weight 15 is capable of lateral movement along central portion 17 of fastening device 13, as represented by arrows L and L' in FIG. 1.

In use, shirt-locking device 11 can be used to weightably affix shirt S down onto undergarment U in the following manner. Pin 19 is pierced through the bottom portion of shirt S and through the top portion, such as the elastic waistband, of undergarment U. Pin 19 is then disposed within hook 21 in a closed position. As such, shirt S is securely affixed down onto undergarment U so as to retain shirt S in a tucked position.

As can be appreciated, because weight 15 is slidably mounted on central portion 17 of fastening device 13, weight 15 serves to improve the performance of shirt-locking device 11 in retaining shirt S down onto undergarment U and in a tucked position.

Preferably, one shirt-locking device 11 is affixed to the front portion of shirt S and undergarment U of the wearer and one shirt-locking device 11 is affixed to the back portion of shirt S and undergarment U. However, it is to be understood that different quantities of shirt-locking devices 11 can be implemented during usage without departing from the spirit of the present invention. Furthermore, it is to be understood that shirt-locking devices 11 can be affixed at different positions of shirt S and undergarment U during usage without departing from the spirit of the present invention.

Referring now to the drawings, there is shown a second embodiment of a shirt-locking device constructed according to the teachings of the present invention, the shirt-locking device being represented generally by reference numeral 31. As can be appreciated, shirt-locking device 31 functions similarly to shirt-locking device 11 in that shirt-locking device 31 can be used to retain a shirt S, or other similar garment, in a tucked position down against an undergarment U, or other similar garment.

Shirt-locking device 31 comprises a fastening device 33, a bracket 34 mounted on fastening device 33 and a weight 35 slidably mounted on bracket 34.

Fastening device 33 is identical with fastening device 13 of shirt-locking device 11. Specifically, fastening device 33 is generally in the shape of a conventional beauty pin and comprises a central portion 37 which is generally cylindrical in shape. One end of central portion 37 is bent and sharpened to form a pin 39 capable of piercing fabrics. The other end of central portion 37 is bent to form an inwardly concave hook 41 which is adapted to hold pin 39 in a closed position therewithin.

Bracket 34 is generally U-shaped and is affixed onto central portion 37 of fastening device 33. Weight 35 is identical with weight 15 of shirt-locking device 11 and is slidably mounted on bracket 34.

The embodiments of the present invention described above are intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A shirt-locking device comprising:

a. a fastening device;

b. a bracket mounted on said fastening device; and c. a weight slidably mounted on said bracket, said weight being approximately 1 ounce and having a bore into which said bracket is disposed;

d. said fastening device comprising a central portion having a first end and a second end, the first end of the central portion being in the shape of a pin and the second end of the central portion being in the shape of a cooperating hook for holding the first end in a closed position;

e. said bracket being generally U shaped and extending down from the first and second ends of said central portion of said fastening device.

* * * * *